US012622458B2

(12) United States Patent
Chehab

(10) Patent No.: US 12,622,458 B2
(45) Date of Patent: May 12, 2026

(54) MULTI-USER SMOKING SYSTEM WITH SELECTION FEATURE

(71) Applicant: MODERN ARABIA LLC, Orlando, FL (US)

(72) Inventor: Waseem Chehab, Gainesville, FL (US)

(73) Assignee: MODERN ARABIA LLC, Orlando, FL (US)

( * ) Notice: Subject to any disclaimer, the term of this patent is extended or adjusted under 35 U.S.C. 154(b) by 386 days.

(21) Appl. No.: 18/303,888

(22) Filed: Apr. 20, 2023

(65) Prior Publication Data

US 2024/0349788 A1 Oct. 24, 2024

(51) Int. Cl.

| | |
|---|---|
| ***A24F 40/30*** | (2020.01) |
| ***A24F 1/30*** | (2006.01) |
| ***A24F 40/05*** | (2020.01) |
| ***A24F 40/485*** | (2020.01) |
| ***A24F 40/50*** | (2020.01) |

(52) U.S. Cl.

CPC ..... *A24F 40/30* (2020.01); *A24F 1/30* (2013.01); *A24F 40/05* (2020.01); *A24F 40/485* (2020.01); *A24F 40/50* (2020.01)

(58) Field of Classification Search

None

See application file for complete search history.

(56) References Cited

U.S. PATENT DOCUMENTS 4,016,561 A * 4/1977 Parker ..... H01H 15/102 340/815.48
8,757,170 B2 6/2014 Kaplani
9,179,710 B2 11/2015 Chaoui
9,498,002 B1 11/2016 Soreide
9,888,714 B2 2/2018 Cameron et al.

(Continued)

FOREIGN PATENT DOCUMENTS

CA 2555523 A1 1/2008
WO 2019173388 A1 3/2019
WO WO-2020039221 A1 * 2/2020 ..... A24F 1/30

OTHER PUBLICATIONS

Reed. "Solenoid Applications" Dec. 3, 2015, Physics Book, Retrieved from https://physicsbook.gatech.edu/Solenoid_Applications, on Sep. 2, 2025 (Year: 2015).*

(Continued)

*Primary Examiner* — Michael H. Wilson
*Assistant Examiner* — Daniel Edward Vakili
(74) *Attorney, Agent, or Firm* — Mark Terry

(57) ABSTRACT

A multi-user smoking system including two or more smoking assemblies, each smoking assembly including a receptacle for holding smoking material, a water vessel, and a stem conduit that fluidly connects the receptacle to the water vessel. The multi-user smoking system further including two or more manifolds, each manifold including an egress outlet, two or more conduits, wherein each particular conduit of the two or more conduits is connected to a water vessel of a smoking assembly of the two or more smoking assemblies, a switching means for fluidly connecting the egress outlet to one of the two or more conduits, and an interface for activating the switching means of each manifold of the two or more manifolds to connect the egress outlet to one of the two or more conduits.

20 Claims, 13 Drawing Sheets

(56) References Cited

U.S. PATENT DOCUMENTS

| | | | | |
|---|---|---|---|---|
| 10,588,343 | B2 | 3/2020 | Butler, Jr. | |
| 10,653,180 | B2 | 5/2020 | Monsees et al. | |
| 10,694,787 | B2 | 6/2020 | Crespo | |
| 10,721,964 | B2 | 7/2020 | Eng et al. | |
| 11,019,847 | B2 | 6/2021 | Watson et al. | |
| 11,103,004 | B2 | 8/2021 | Madani | |
| 11,224,253 | B2 | 1/2022 | Fernando et al. | |
| 2007/0215165 | A1* | 9/2007 | Mazakis | A24F 1/30 131/257 |
| 2010/0326453 | A1* | 12/2010 | Chaoui | A24F 1/30 131/173 |
| 2011/0180080 | A1 | 7/2011 | Fares | |
| 2012/0256110 | A1* | 10/2012 | Legaspi | H01F 7/1607 251/129.15 |
| 2018/0027872 | A1 | 2/2018 | Galaviz, Jr. | |
| 2018/0103683 | A1 | 4/2018 | Parker | |
| 2022/0264953 | A1 | 8/2022 | Cole | |

OTHER PUBLICATIONS

Fisk, "What is a Hookah Purge Valve and Hose Port?", Hookah.com, Sep. 7, 2012, retrieved from https://hookah.com/blog/romancing-the-smoke-purge-valve-and-hose-ports, on Sep. 2, 2025 (Year: 2012).*

* cited by examiner

MULTI-USER SMOKING SYSTEM WITH SELECTION FEATURE

CROSS-REFERENCE TO RELATED APPLICATIONS

Not Applicable.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

TECHNICAL FIELD

The claimed subject matter relates to the field of smoking articles and, more specifically, the claimed subject matter relates to the field of smoking systems and methods for multiple users.

BACKGROUND

A waterpipe is a filtration device generally used for smoking cannabis, tobacco, or other herbal substances. A waterpipe is constructed from a water-holding vessel and a bowl connected to the vessel. The bowl is used for heating or vaporizing and then smoking packing material, which refers to tobacco, flavored tobacco (often mu'assel), cannabis, hashish, opium, or the like. The waterpipe further includes a stem, which is a tubular element that guides air and smoke downward from the bowl to below water level within the vessel, whence it bubbles upward during use. A hose with a mouthpiece may be attached to the vessel, which allows the user to inhale the smoke that has passed through the water vessel. There various types of waterpipes, including hookahs and bongs.

One of the drawbacks associated with conventional waterpipes is that the user can only smoke one type of packing material within the bowl at one time. For example, if the user would like to smoke peach flavored tobacco, the user fills the bowl with said peach flavored tobacco, which allows him to heat or vaporize and then smoke the peach flavored tobacco. But if the user would like to switch to another flavor of tobacco during the smoking session, the user would have to remove the peach flavored tobacco from the bowl, clean the remaining debris from the bowl, and then fill the clean bowl with the new flavor of tobacco. This can be tedious and time consuming for user.

It should also be noted that smoking sessions can often be a social activity. Smokers enjoy gathering and smoking from a waterpipe all at once. One solution to this demand is a hookah with multiple hoses that allows multiple users to smoke from the same bowl at once. One of the drawbacks associated with this solution, however, is that the smokers can only smoke one type of packing material within the bowl at one time. Again, the smokers would be required to change out the packing material in the bowl in order to switch to smoking a different packing material.

Therefore, what is needed is a system and method for improving the problems with the prior art, and more particularly for a more expedient and efficient method and system for allowing groups of smokers to engage in smoking activities.

BRIEF SUMMARY

In one embodiment, a multi-user smoking system and method is disclosed. This Summary is provided to introduce a selection of disclosed concepts in a simplified form that are further described below in the Detailed Description including the drawings provided. This Summary is not intended to identify key features or essential features of the claimed subject matter. Nor is this Summary intended to be used to limit the claim subject matter's scope.

In one embodiment, the multi-user smoking system comprises: a) two or more smoking assemblies, each smoking assembly including: 1) a receptacle for holding smoking material, 2) a water vessel, and 3) a stem conduit that fluidly connects the receptacle to the water vessel; b) two or more manifolds, each manifold including: 1) an egress outlet, 2) two or more conduits, wherein each conduit of the two or more conduits is connected to a water vessel of a smoking assembly of the two or more smoking assemblies, and 3) a switching means for fluidly connecting the egress outlet to one of the two or more conduits; and c) a base station communicatively coupled with the two or more manifolds, the base station including a processor and memory configured for activating the switching means of each manifold of the two or more manifolds to connect the egress outlet to one of the two or more conduits In another embodiment, the multi-user smoking system comprises: a) two or more smoking assemblies, each smoking assembly including: 1) a receptacle for holding smoking material, 2) a water vessel, and 3) a stem conduit that fluidly connects the receptacle to the water vessel; b) two or more manifolds, each manifold including: 1) an egress outlet, 2) two or more conduits, wherein each conduit of the two or more conduits is connected to a water vessel of a particular smoking assembly of the two or more smoking assemblies, and 3) a switching means for fluidly connecting the egress outlet to one of the two or more conduits; c) two or more smoking hoses, each smoking hose fluidly coupled with an egress outlet of a particular manifold of the two or more manifolds, and each smoking hose including an interface for indicating a selection of a receptacle from a particular smoking assembly of the two or more smoking assemblies; and d) a base station communicatively coupled with the two or more manifolds, the base station including a processor and memory configured for: 1) reading from each hose of the two or more smoking hoses a selection of a receptacle from a particular smoking assembly of the two or more smoking assemblies, and 2) activating the switching means of each manifold of the two or more manifolds to connect the egress outlet to one of the two or more conduits, according to the selections that were read from each hose of the two or more smoking hoses.

In another embodiment, the multi-user smoking system comprises: a) two or more smoking assemblies, each smoking assembly including: 1) a receptacle for holding smoking material, 2) a water vessel, and 3) a stem conduit that fluidly connects the receptacle to the water vessel; and b) two or more manifolds, each manifold including: 1) an egress outlet, 2) two or more conduits, wherein each particular conduit of the two or more conduits is connected to a water vessel of a smoking assembly of the two or more smoking assemblies, 3) a switching means for fluidly connecting the egress outlet to one of the two or more conduits, and 4) an interface for activating the switching means of each manifold of the two or more manifolds to connect the egress outlet to one of the two or more conduits.

Additional aspects of the claimed subject matter will be set forth in part in the description which follows, and in part will be obvious from the description, or may be learned by practice of the claimed subject matter. The aspects of the claimed subject matter will be realized and attained by means of the elements and combinations particularly pointed out in the appended claims. It is to be understood that both the foregoing general description and the following detailed description are exemplary and explanatory only and are not restrictive of the disclosed subject matter, as claimed.

BRIEF DESCRIPTION OF THE SEVERAL VIEWS OF THE DRAWINGS

The accompanying drawings, which are incorporated in and constitute part of this specification, illustrate embodiments of the claimed subject matter and together with the description, serve to explain the principles of the claimed subject matter. The embodiments illustrated herein are presently preferred, it being understood, however, that the claimed subject matter is not limited to the precise arrangements and instrumentalities shown, wherein:

DETAILED DESCRIPTION

Figure 1:
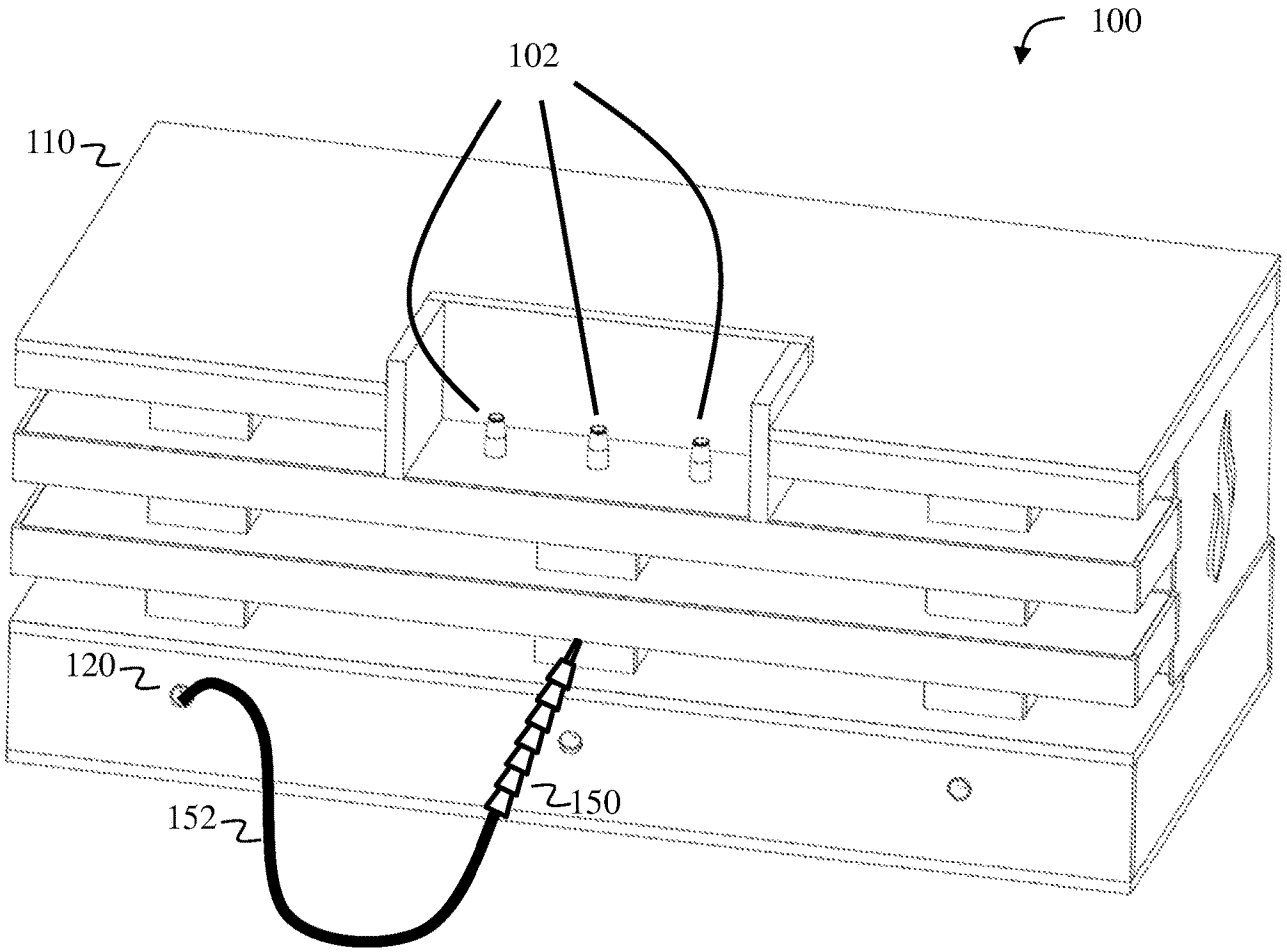
FIG. 1 is an illustration of a top perspective view of a multi-user smoking system, in accordance with one embodiment.

It should be understood that the embodiments disclosed herein are only examples of the many advantageous uses of the innovative teachings of the claimed embodiments. In general, statements made in the specification of the present application do not necessarily limit any of the various claimed embodiments. Moreover, some statements may apply to some inventive features but not to others. In general, unless otherwise indicated, singular elements may be in the plural and vice versa with no loss of generality. In the drawing like numerals refer to like parts through several views.

The disclosed embodiments improve upon the problems with the prior art by providing a multi-user smoking system and method that reduces or eliminates the need for smokers to change the smoking material in a bowl or to change hoses when desiring to change smoking material. The disclosed embodiments allow a user who wants to smoke a different flavor to simply press a button, which changes the origin of the smoke he is inhaling. The disclosed embodiments provide a system that has multiple different bowls, each with different smoking material (tobacco, hashish, flavored tobacco, etc.), and multiple different hoses, which allows multiple users to smoke multiple different bowls at the same time. This is advantageous for users, as it provides greater flexibility in the use of a smoking system and allows for simultaneous use by multiple users. The main benefit of the claimed subject matter is an improvement in multi-user smoking systems by increasing the ease-of-use while allowing a communal smoking experience.

We shall now refer to the drawing FIGS. 1-15 in which like reference designators refer to like elements, wherein the multi-user smoking system 100 is shown and described. FIG. 1 is an illustration of a top perspective view of the multi-user smoking system 100, in accordance with one embodiment. FIG. 1 shows the multi-user smoking system 100 includes a piece of furniture 110, which may be a coffee table, a table, or an elevated surface. Also included is a cutout within which at least three bowls 102 are located. A bowl is a receptacle that holds smoking material, such as tobacco, flavored, tobacco, hashish, etc. The smoking material or charcoal is burnt using a lighter or match and the smoke is inhaled by users.

FIG. 1 further shows that the multi-user smoking system 100 includes at least three smoke outlets 120 on the front face of the device 110, with three others located on the rear of the device 110 (not shown). A smoke outlet is configured for egress of smoke from one of the bowls. Connected to the smoke outlet 120 is a smoking house 152 with a mouthpiece 150 at the end of the smoking hose. Smoke from a bowl travels through the smoke outlet 120, via the house 152 and through the mouthpiece 150 to the user.

Figure 2:
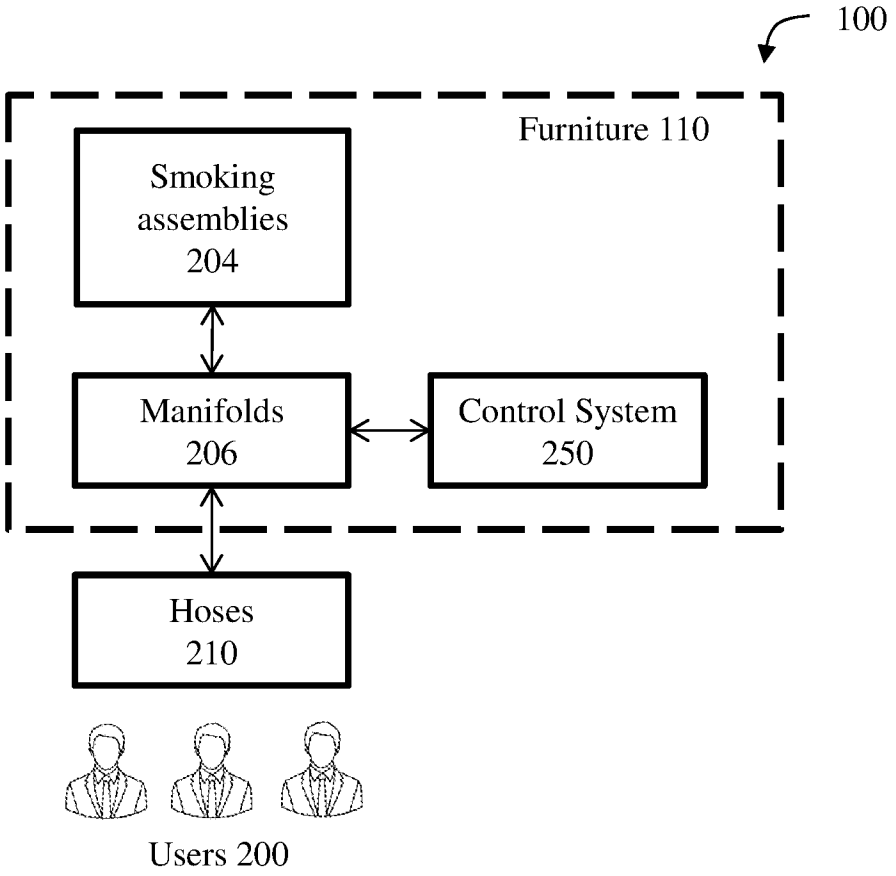
FIG. 2 is a block diagram illustrating the main components of the multi-user smoking system, in accordance with one embodiment.

FIG. 2 is a block diagram illustrating the main components of the multi-user smoking system 100, in accordance with one embodiment. The multi-user smoking system 100 comprises two or more smoking assemblies 204, each smoking assembly including: 1) a receptacle (such as a bowl 102) for holding smoking material, 2) a water vessel, and 3) a stem conduit that fluidly connects the receptacle to the water vessel. The multi-user smoking system 100 also comprises two or more manifolds 206, each manifold including: 1) an egress outlet (such as 120), 2) two or more conduits, wherein each conduit of the two or more conduits is connected to a water vessel of a particular smoking assembly of the two or more smoking assemblies, and 3) a switching means for fluidly connecting the egress outlet to one of the two or more conduits; c) two or more smoking hoses 210 (such as hose 152), each smoking hose fluidly coupled with an egress outlet of a particular manifold of the two or more manifolds, and each smoking hose including an interface for indicating a selection of a receptacle from a particular smoking assembly of the two or more smoking assemblies.

The multi-user smoking system 100 also comprises a base station or control system 250 communicatively coupled with the two or more manifolds 206, the control system 250 including a processor and memory configured for: 1) reading from each hose of the two or more smoking hoses a selection of a receptacle from a particular smoking assembly of the two or more smoking assemblies, and 2) activating the switching means of each manifold of the two or more manifolds to connect the egress outlet to one of the two or more conduits, according to the selections that were read from each hose of the two or more smoking hoses. Said multi-user smoking system 100 allows multiple users 200 to utilize the two or more smoking hoses 210 to smoke from the two or more receptacles (or bowls) of the two or more smoking assemblies 204 without switching hoses. That is, a single user can utilize a single smoking hose to smoke from any of the two or more receptacles (or bowls) without switching hoses. Said single user can also dynamically switch receptacles (or bowls) without switching hoses. Therefore, each hose has access to all of the receptacles (or bowls).

Figure 3:
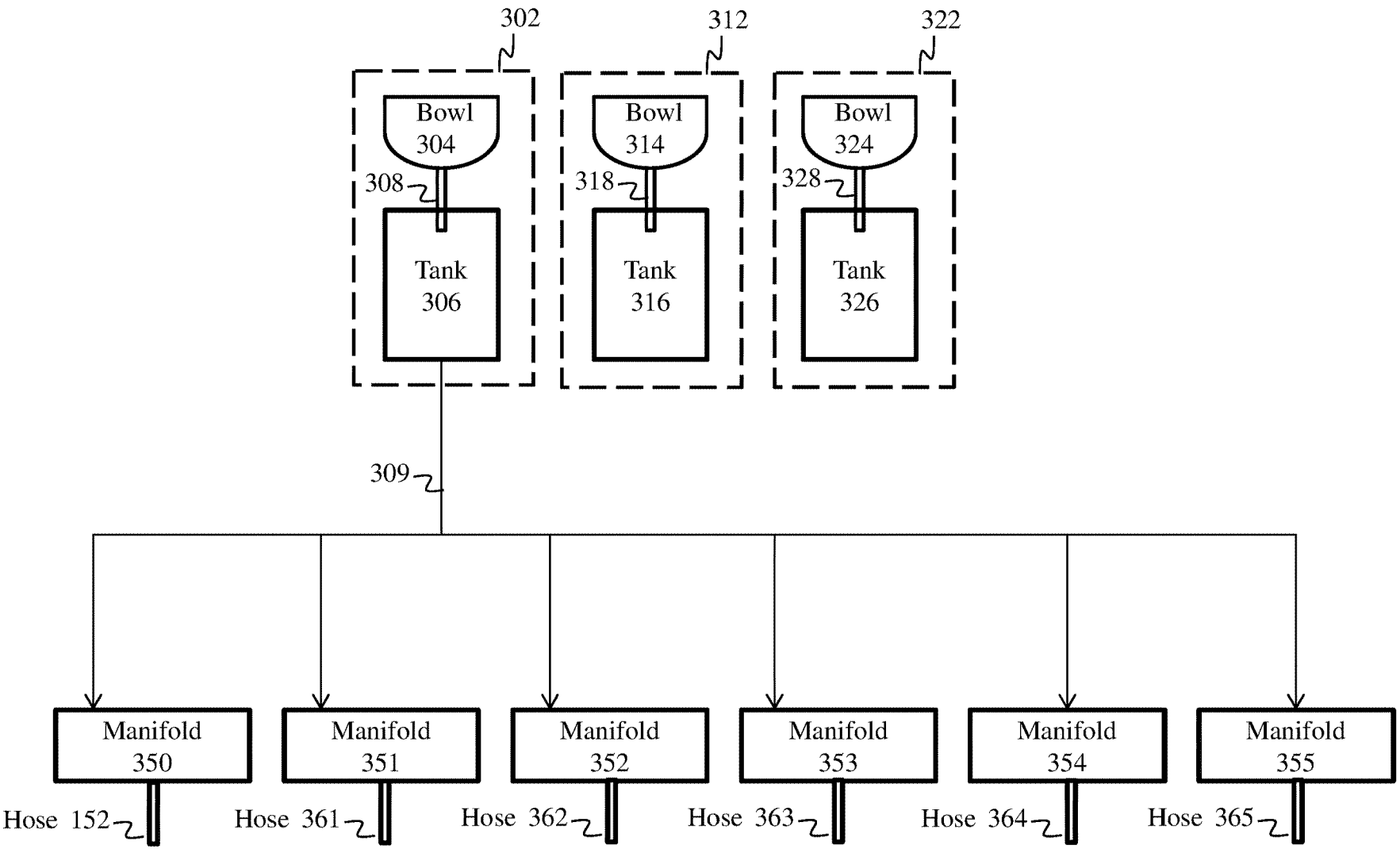
FIG. 3 is a block diagram illustrating the smoking assembly and manifold components of the multi-user smoking system, in accordance with one embodiment.

FIG. 3 is a block diagram illustrating the smoking assembly and manifold components of the multi-user smoking system 100, in accordance with one embodiment. FIG. 3 shows the multi-user smoking system 100 comprises three smoking assemblies 302, 312, 322, each smoking assembly including: 1) a receptacle (bowls 304, 314, 324 respectively)) for holding smoking material, 2) a water vessel or tank 306, 316, 326, respectively, and 3) a stem conduit 308, 318, 328, respectively, that fluidly connects the receptacle to the water vessel. Smoking assembly 302 comprises a bowl 304, tank 306 and stem conduit 308. Smoking assembly 312 comprises a bowl 314, tank 316 and stem conduit 318. Smoking assembly 322 comprises a bowl 324, tank 326 and stem conduit 328. FIG. 3 also shows six manifolds 350, 351, 352, 353, 354, 355, each manifold with their own hose 152, 361, 362, 363, 364 and 365, respectively. Each smoking hose is fluidly coupled with an egress outlet of a particular manifold.

Each of the manifolds 350, 351, 352, 353, 354, 355 include: 1) an egress outlet (such as 120), 2) two or more conduits, wherein each conduit of the two or more conduits is connected to a water vessel of a particular smoking assembly of the two or more smoking assemblies, and 3) a switching means for fluidly connecting the egress outlet to one of the two or more conduits. FIG. 3 shows that a single conduit 309 connects the tank 306 to all of the six manifolds 350, 351, 352, 353, 354, 355. Conduit 309 transports smoke from the tank 306 to all of the manifolds. Although the claimed embodiments allow all tanks to be connected to all of the manifolds using separate conduits, FIG. 3 shows only a single conduit 309 for illustrative purposes only.

Figure 4:
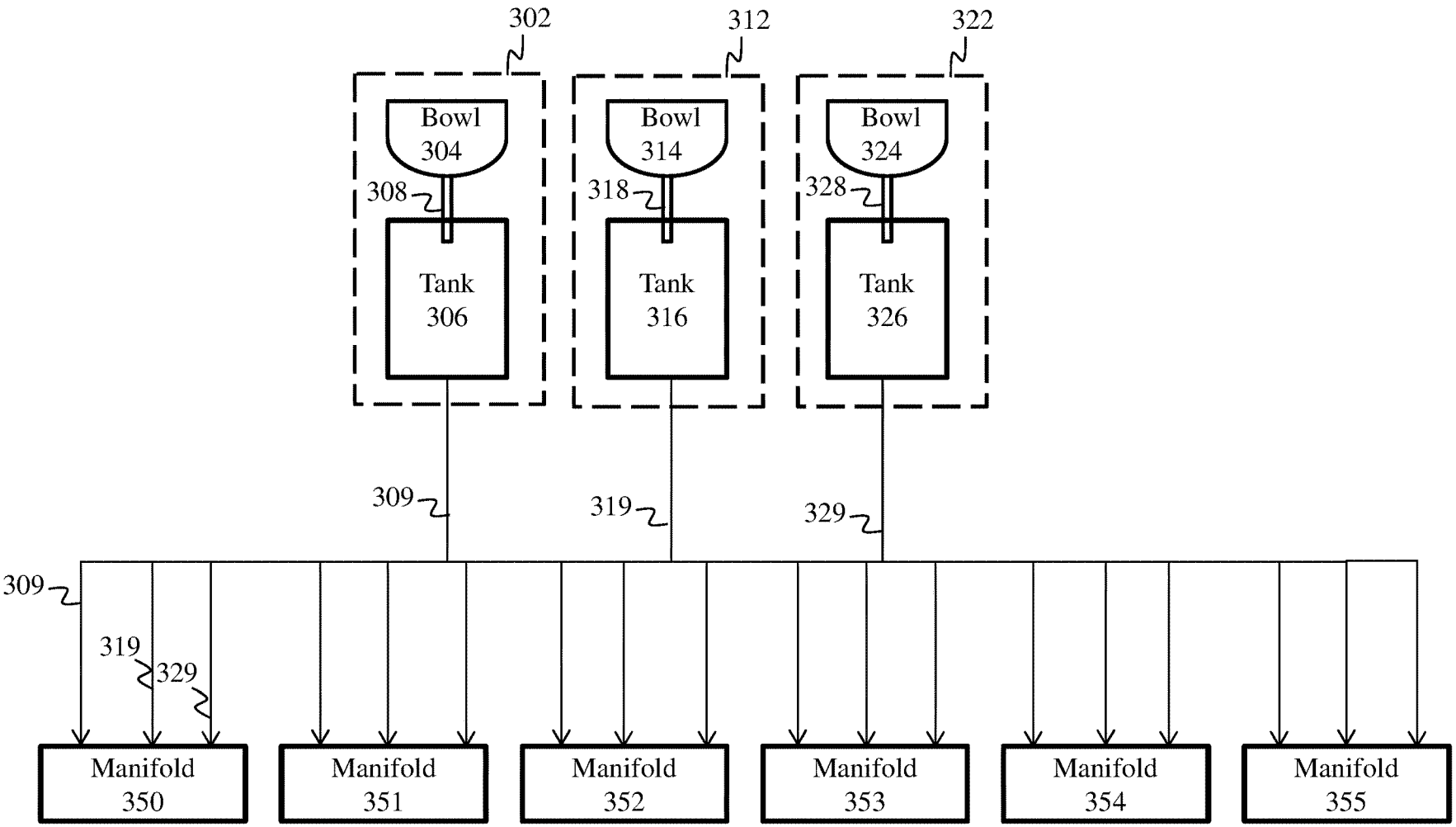
FIG. 4 is another block diagram illustrating the smoking assembly and manifold components of the multi-user smoking system, in accordance with one embodiment.

FIG. 4 is another block diagram illustrating the smoking assembly and manifold components of the multi-user smoking system 100, in accordance with one embodiment. FIG. 4 is identical to FIG. 3 except that all of the tanks are connected to all of the manifolds using separate conduits. FIG. 4 shows that a single conduit 309 connects the tank 306 to all of the six manifolds 350, 351, 352, 353, 354, 355, a single conduit 319 connects the tank 316 to all of the six manifolds, and a single conduit 329 connects the tank 326 to all of the six manifolds.

FIG. 4 shows that manifold 350, for example, has three conduits entering the manifold, conduit 309 from tank 306, conduit 319 from tank 316 and conduit 329 from tank 326. This allows manifold 350 to receive smoke from all of the tanks at the same time. The same applies to all of the manifolds in FIG. 4.

Figure 5:
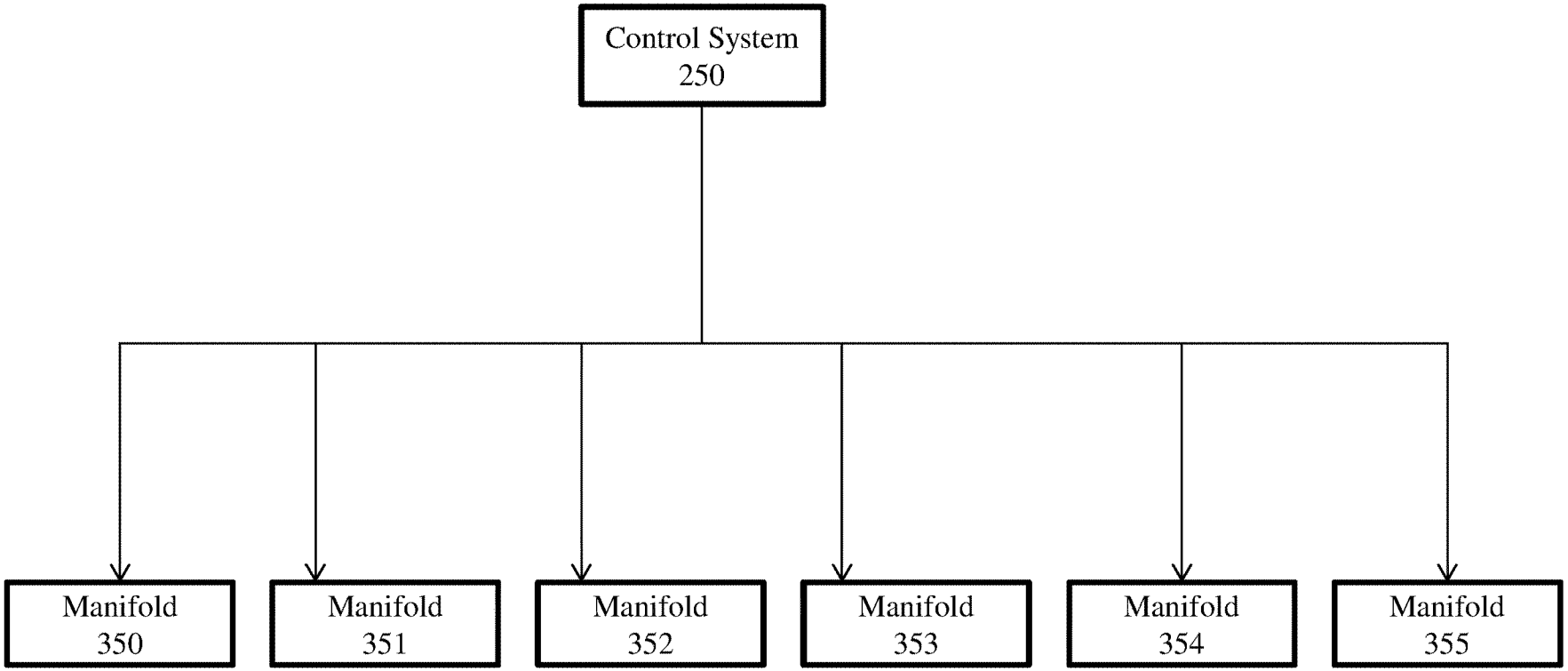
FIG. 5 is a block diagram illustrating the control system and manifold components of the multi-user smoking system, in accordance with one embodiment.

FIG. 5 is a block diagram illustrating the control system and manifold components of the multi-user smoking system 100, in accordance with one embodiment. FIG. 5 shows that control system 250 is connected to all of the six manifolds 350, 351, 352, 353, 354, 355. Control system 250 controls all of the manifolds, as described in greater detail below.

Figure 6:
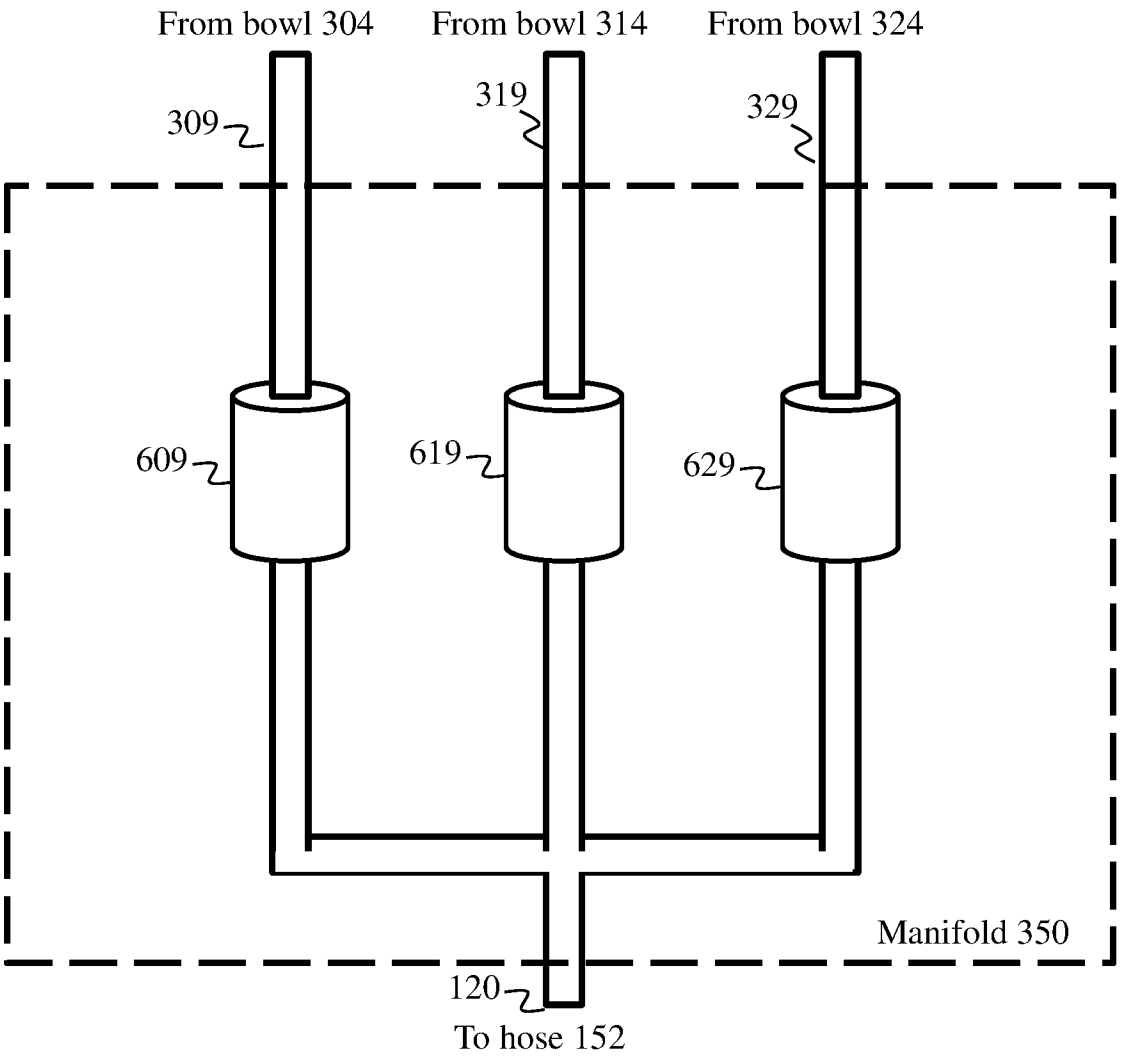
FIG. 6 is a block diagram illustrating the interior of the manifold components of the multi-user smoking system, in accordance with one embodiment.

FIG. 6 is a block diagram illustrating the interior of the manifold components of the multi-user smoking system 100, in accordance with one embodiment. FIG. 6 shows that manifold 350 has three conduits entering the manifold, conduit 309 from bowl 304, conduit 319 from bowl 314 and conduit 329 from bowl 324. This allows manifold 350 to receive smoke from all of the bowls at the same time. Conduit 309 flows into a solenoid 609, which allow smoke to continue through conduit 309 if the solenoid is open, but occludes or stops smoke from continuing through conduit 309 if the solenoid is closed. The same applies to conduit 319/solenoid 619, as well as conduit 329/solenoid 629.

After passing their respective solenoids, all conduits 309, 319, 329 join and meet at smoke egress outlet 120. If the user desires to smoke from bowl 304, then solenoid 609 is activated to be open, while solenoids 619, 629 are activated to be closed. If the user desires to smoke from bowl 314, then solenoid 619 is activated to be open, while solenoids 609, 629 are activated to be closed. If the user desires to smoke from bowl 324, then solenoid 629 is activated to be open, while solenoids 619, 609 are activated to be closed.

Figure 7:
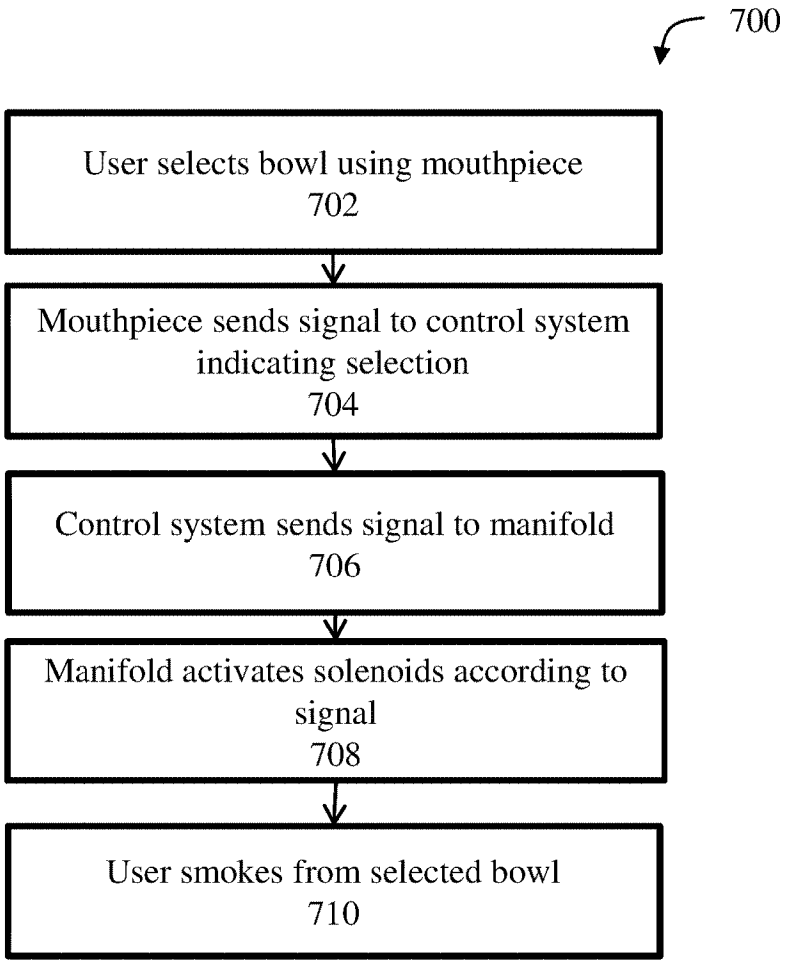
FIG. 7 is a flowchart depicting the process of selecting a bowl of the multi-user smoking system, in accordance with one embodiment.

FIG. 7 is a flowchart depicting the process 700 of selecting a bowl of the multi-user smoking system 100, in accordance with one embodiment. The process 700 can best be described by example. The process 700 begins with the user 200 handling the mouthpiece 150 of hose 152 and using the interface on the mouthpiece, which may be a button, for example, to select a bowl from the set of bowls 102. The user may, for example, push a button until a light indicates which bowl has been selected. In this case, the user 200 selects the first bowl 304.

In step 704, the mouthpiece 150 transmits a RF signal to the control system 250, which receives the signal using a RF receiver. Said signal includes an identification of the manifold (350 in this case) and the bowl selected by the user (304 in this case). In step 706, the control system 250 determines which solenoids to open and close based on the user's selection, and then transmits a signal to manifold 350 indicating that it should close solenoids 619 and 629 (controlling ingress of smoke from bowls 314, 324), while opening solenoid 609 (controlling ingress of smoke from bowl 304). In step 708, manifold 350 receives the signal from the control system and proceeds to close solenoids 619 and 629 (controlling ingress of smoke from bowls 314, 324), and open solenoid 609 (controlling ingress of smoke from bowl 304). In step 710, the user 200 is able to inhale through the mouthpiece 150 so as to inhale smoke from bowl 304.

In another embodiment, if the user desires to smoke from bowl 304, then solenoid 609 is activated to be open, while solenoids 619, 629 are activated to be closed. If the user desires to smoke from bowl 314, then solenoid 619 is activated to be open, while solenoids 609, 629 are activated to be closed. If the user desires to smoke from bowl 324, then solenoid 629 is activated to be open, while solenoids 619, 609 are activated to be closed.

Figure 8:
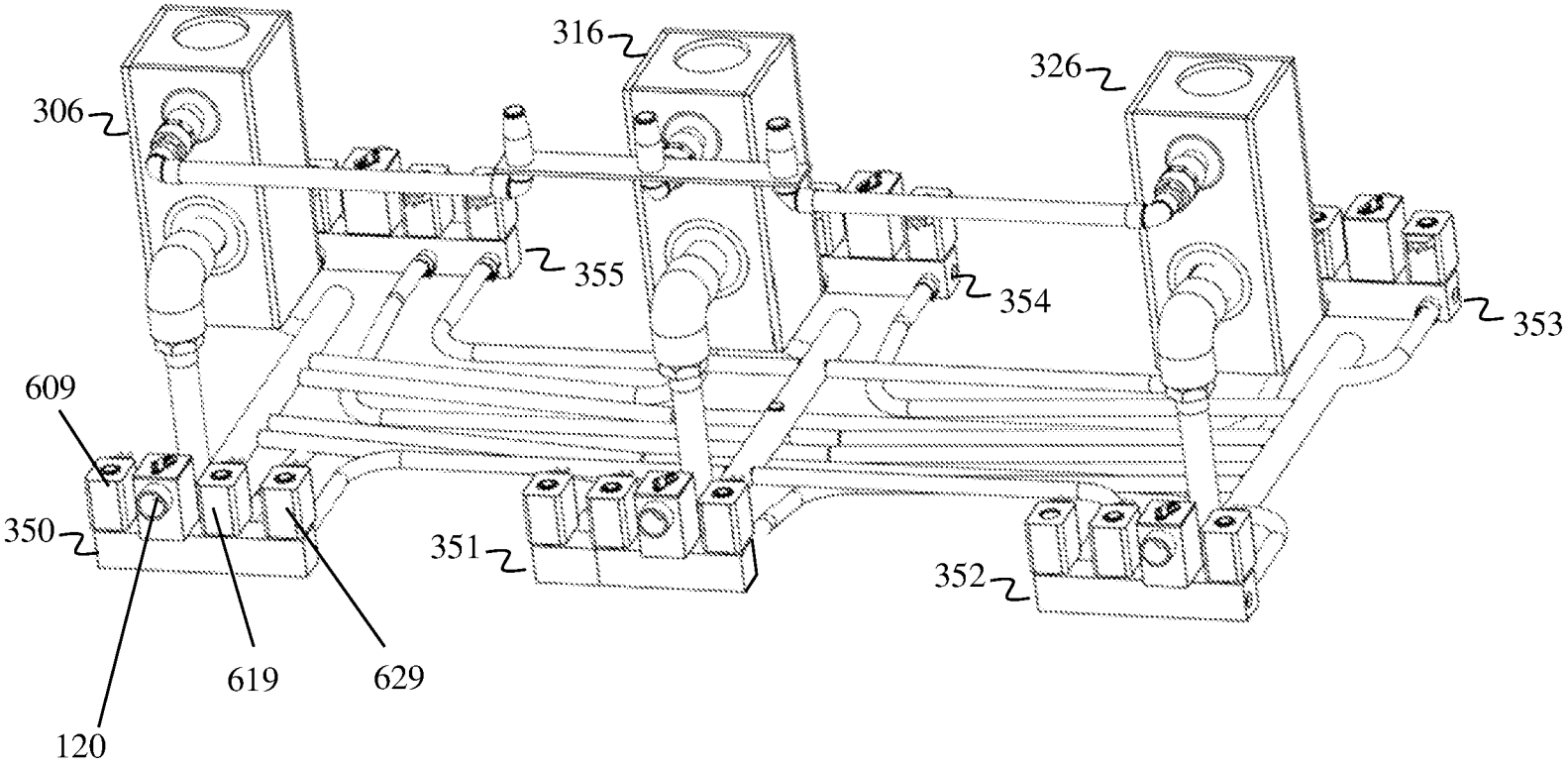
FIG. 8 is an illustration of a front perspective view of the smoking assembly and manifold components of the multi-user smoking system, in accordance with one embodiment.
Figure 9:
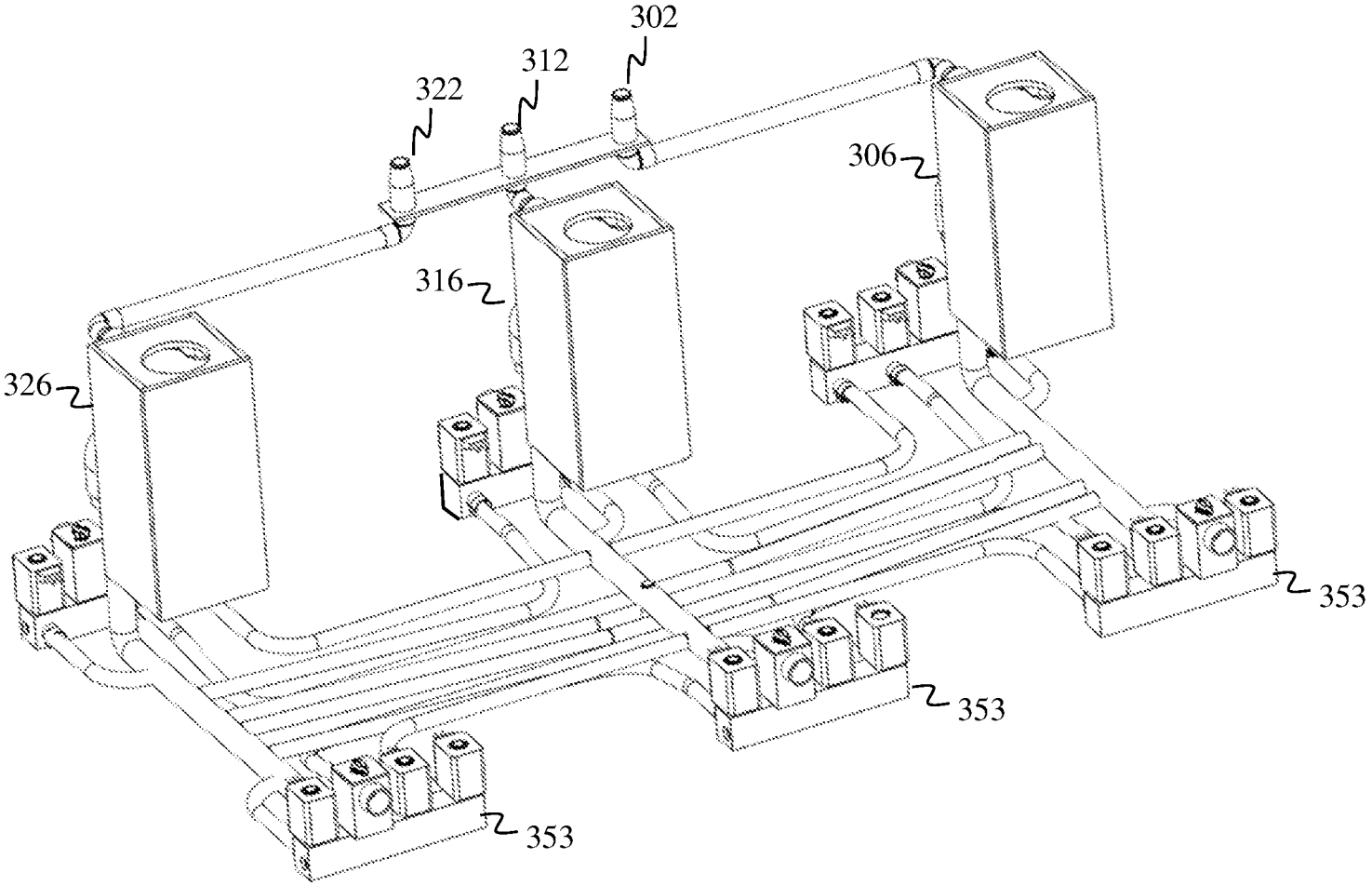
FIG. 9 is an illustration of a rear perspective view of the smoking assembly and manifold components of the multi-user smoking system, in accordance with one embodiment.
Figure 10:
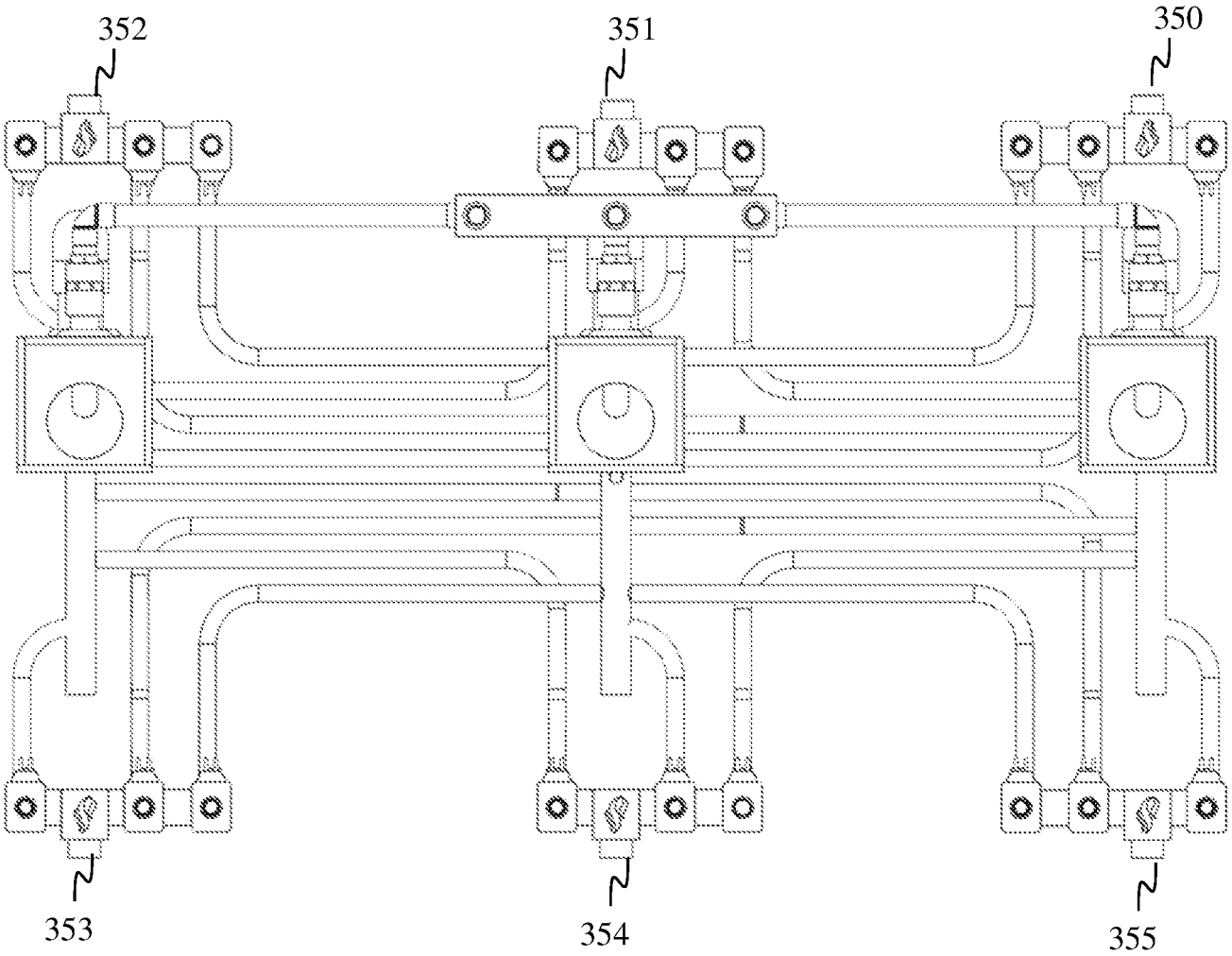
FIG. 10 is an illustration of a top view of the smoking assembly and manifold components of the multi-user smoking system, in accordance with one embodiment.

FIG. 8 is an illustration of a front perspective view of the smoking assembly and manifold components of the multi-user smoking system 100, in accordance with one embodiment, while FIG. 9 shows a rear perspective view and FIG. 10 shows a top view. FIGS. 8-10 show six manifolds 350, 351, 352, 353, 354, 355 and three tanks 306, 316, 326, wherein each tank is connected all six manifolds via conduits that transport smoke. FIGS. 8-10 also show the three solenoids 609, 619 and 629, as well as smoke egress outlet 120. FIGS. 8-10 also show three bowls or receptacles 302, 312, 322, wherein each bowl or receptacle is connected to one of three tanks 306, 316, 326 via a conduit that transports smoke.

Figure 12:
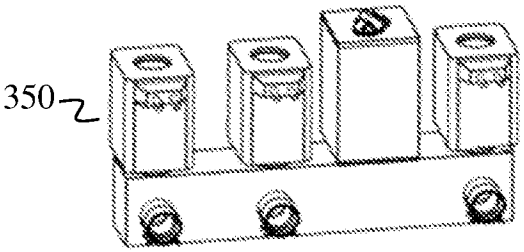
FIG. 12 is an illustration of a rear perspective view of the manifold component of the multi-user smoking system, in accordance with one embodiment.
Figure 11:
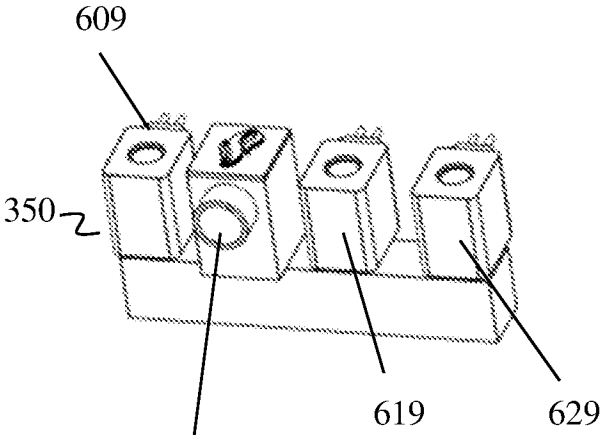
FIG. 11 is an illustration of a front perspective view of the manifold component of the multi-user smoking system, in accordance with one embodiment.

FIG. 11 is an illustration of a front perspective view of the manifold component of the multi-user smoking system, in accordance with one embodiment, while FIG. 12 shows a rear perspective view. FIGS. 11-12 show manifold 350 including the three solenoids 609, 619 and 629, as well as smoke egress outlet 120.

Figure 14:
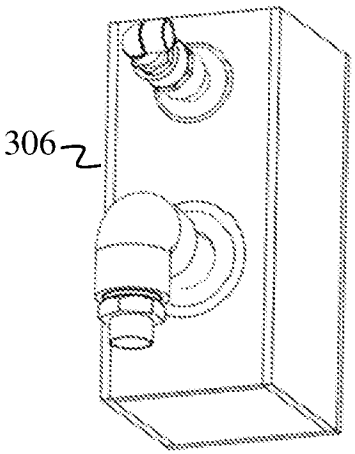
FIG. 14 is an illustration of a bottom perspective view of the smoking assembly component of the multi-user smoking system, in accordance with one embodiment.
Figure 13:
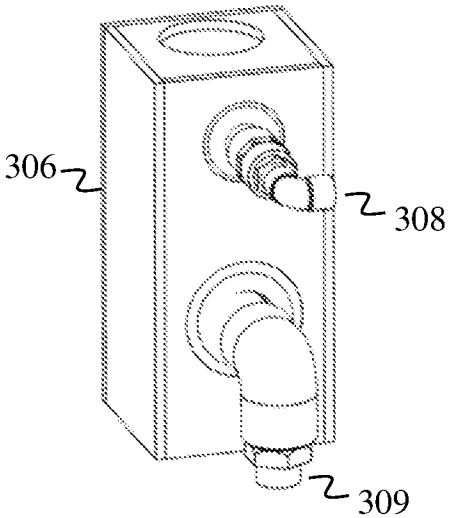
FIG. 13 is an illustration of a top perspective view of the smoking assembly component of the multi-user smoking system, in accordance with one embodiment.

FIG. 13 is an illustration of a top perspective view of the smoking assembly component of the multi-user smoking system, in accordance with one embodiment, while FIG. 14 shows a bottom perspective view. FIGS. 13-14 show a water vessel or tank 306, a conduit 308 that fluidly connects the receptacle or bowl 302 to the water vessel, and a conduit 309 that connects the tank 306 to all of the six manifolds 350, 351, 352, 353, 354, 355.

Figure 15:
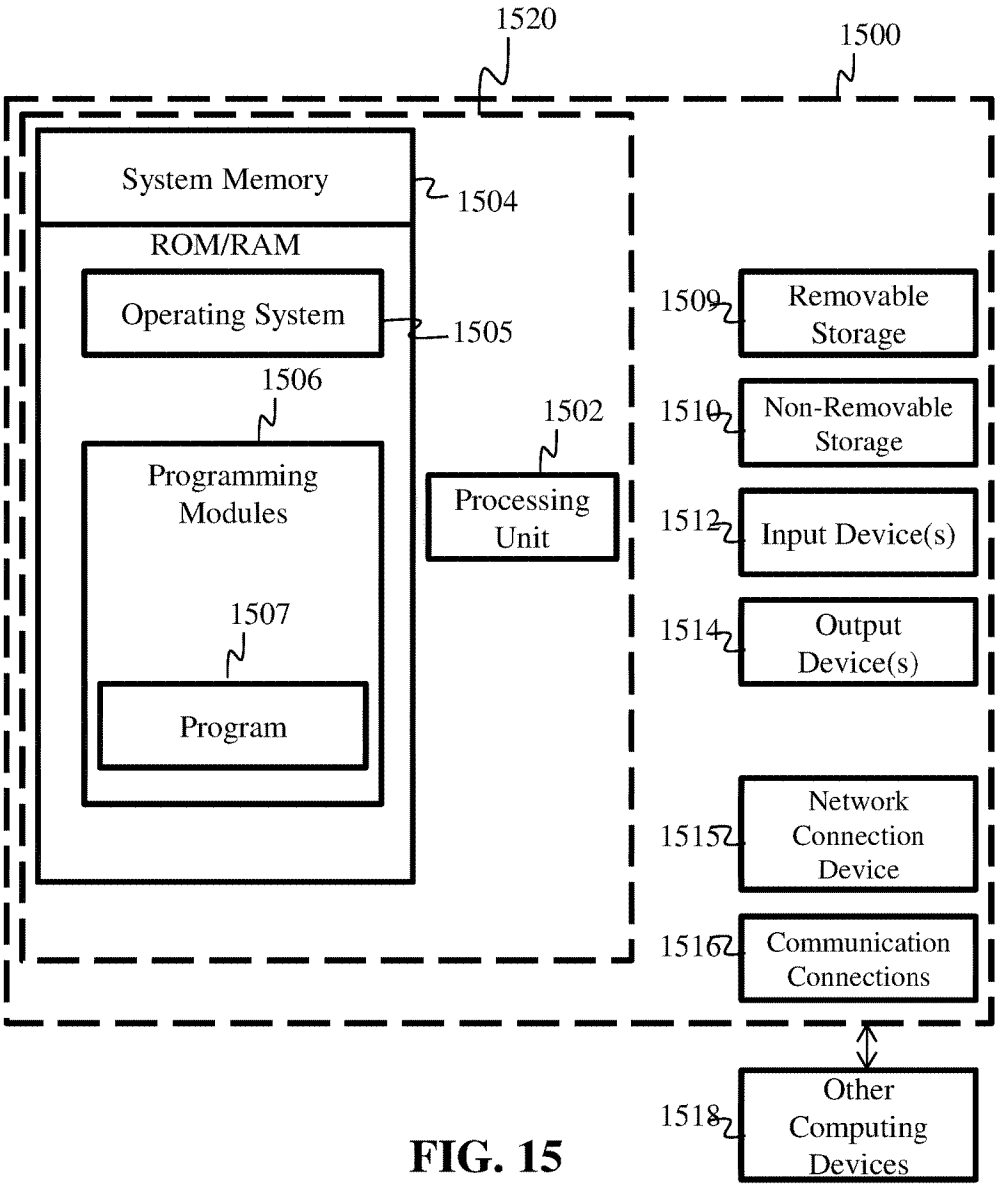
FIG. 15 is a block diagram depicting a computing system useful for implementing the multi-user smoking system, in accordance with one embodiment.

FIG. 15 is a block diagram of a system including an example computing device 400 and other computing devices. Consistent with the embodiments described herein, the aforementioned actions performed by the control system 250 may be implemented in a computing device, such as the computing device 1500 of FIG. 15. Any suitable combination of hardware, software, or firmware may be used to implement the control system 250. The aforementioned system, device, and processors are examples and other systems, devices, and processors may comprise the aforementioned computing device. Furthermore, computing device 400 may comprise an operating environment for process 700, as described above. Process 700 may operate in other environments and are not limited to computing device 1500.

With reference to FIG. 15, a system consistent with an embodiment may include a plurality of computing devices, such as computing device 1500. In a basic configuration, computing device 400 may include at least one processing unit 1502 and a system memory 1504. Depending on the configuration and type of computing device, system memory 1504 may comprise, but is not limited to, volatile (e.g. random-access memory (RAM)), non-volatile (e.g. read-only memory (ROM)), flash memory, or any combination or memory. System memory 1504 may include operating system 1505, and one or more programming modules 1506. Operating system 1505, for example, may be suitable for controlling computing device 1500's operation. In one embodiment, programming modules 1506 may include, for example, a program module 1507 for executing the actions of 250. Furthermore, embodiments may be practiced in conjunction with a graphics library, other operating systems, or any other application program and is not limited to any particular application or system. This basic configuration is illustrated in FIG. 15 by those components within a dashed line 1520.

Computing device 1500 may have additional features or functionality. For example, computing device 1500 may also include additional data storage devices (removable and/or non-removable) such as, for example, magnetic disks, optical disks, or tape. Such additional storage is illustrated in FIG. 15 by a removable storage 1509 and a non-removable storage 1510. Computer storage media may include volatile and nonvolatile, removable and non-removable media implemented in any method or technology for storage of information, such as computer readable instructions, data structures, program modules, or other data. System memory 1504, removable storage 1509, and non-removable storage 1510 are all computer storage media examples (i.e. memory storage.) Computer storage media may include, but is not limited to, RAM, ROM, electrically erasable read-only memory (EEPROM), flash memory or other memory technology, CD-ROM, digital versatile disks (DVD) or other optical storage, magnetic cassettes, magnetic tape, magnetic disk storage or other magnetic storage devices, or any other medium which can be used to store information and which can be accessed by computing device 1500. Any such computer storage media may be part of device 1500. Computing device 1500 may also have input device(s) 1512 such as a keyboard, a mouse, a pen, a sound input device, a camera, a touch input device, etc. Output device(s) 1514 such as a display, speakers, a printer, etc. may also be included. Computing device 1500 may also include a vibration device capable of initiating a vibration in the device on command, such as a mechanical vibrator or a vibrating alert motor. The aforementioned devices are only examples, and other devices may be added or substituted.

Computing device 1500 may also contain a network connection device 1515 that may allow device 1500 to communicate with other computing devices 1518, such as over a network in a distributed computing environment, for example, an intranet or the Internet. Device 1515 may be a wired or wireless network interface controller, a network interface card, a network interface device, a network adapter or a LAN adapter. Device 1515 allows for a communication connection 1516 for communicating with other computing devices 1518. Communication connection 1516 is one example of communication media. Communication media may typically be embodied by computer readable instructions, data structures, program modules, or other data in a modulated data signal, such as a carrier wave or other transport mechanism, and includes any information delivery media. The term "modulated data signal" may describe a signal that has one or more characteristics set or changed in such a manner as to encode information in the signal. By way of example, and not limitation, communication media may include wired media such as a wired network or direct-wired connection, and wireless media such as acoustic, radio frequency (RF), infrared, and other wireless media. The term computer readable media as used herein may include both computer storage media and communication media.

As stated above, a number of program modules and data files may be stored in system memory 1504, including operating system 1505. While executing on processing unit 1502, programming modules 1506 (e.g. program module 1507) may perform processes including, for example, one or more of the stages of the process 700 as described above. The aforementioned processes are examples, and processing unit 1502 may perform other processes. Other programming modules that may be used in accordance with embodiments herein may include electronic mail and contacts applications, word processing applications, spreadsheet applications, database applications, slide presentation applications, drawing or computer-aided application programs, etc.

Generally, consistent with embodiments herein, program modules may include routines, programs, components, data structures, and other types of structures that may perform particular tasks or that may implement particular abstract data types. Moreover, embodiments herein may be practiced with other computer system configurations, including hand-held devices, multiprocessor systems, microprocessor-based or programmable consumer electronics, minicomputers, mainframe computers, and the like. Embodiments herein may also be practiced in distributed computing environments where tasks are performed by remote processing devices that are linked through a communications network. In a distributed computing environment, program modules may be located in both local and remote memory storage devices.

Furthermore, embodiments herein may be practiced in an electrical circuit comprising discrete electronic elements, packaged or integrated electronic chips containing logic gates, a circuit utilizing a microprocessor, or on a single chip (such as a System on Chip) containing electronic elements or microprocessors. Embodiments herein may also be practiced using other technologies capable of performing logical operations such as, for example, AND, OR, and NOT, including but not limited to mechanical, optical, fluidic, and quantum technologies. In addition, embodiments herein may be practiced within a general purpose computer or in any other circuits or systems.

Embodiments herein, for example, are described above with reference to block diagrams and/or operational illustrations of methods, systems, and computer program products according to said embodiments. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While certain embodiments have been described, other embodiments may exist. Furthermore, although embodiments herein have been described as being associated with data stored in memory and other storage mediums, data can also be stored on or read from other types of computer-readable media, such as secondary storage devices, like hard disks, floppy disks, or a CD-ROM, or other forms of RAM or ROM. Further, the disclosed methods' stages may be modified in any manner, including by reordering stages and/or inserting or deleting stages, without departing from the claimed subject matter.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A multi-user smoking system comprising:

a) two or more smoking assemblies, each smoking assembly including: 1) a receptacle for holding smoking material, 2) a water vessel, and 3) a stem conduit that fluidly connects the receptacle to the water vessel;

b) two or more manifolds, each manifold including: 1) an egress outlet, 2) two or more conduits, wherein each conduit of the two or more conduits is connected to a water vessel of a smoking assembly of the two or more smoking assemblies, and 3) a switching means for fluidly connecting the egress outlet to one of the two or more conduits, the switching means mechanism disposed within the manifold, the switching means comprising a solenoid-actuated valve connected to each of the two or more conduits, each solenoid-actuated valve configured to selectively permit or prevent smoke to flow from a conduit of the two or more conduits to the egress outlet, such that opening of one solenoid-actuated valve automatically closes the remaining solenoid-actuated valves;

c) a base station communicatively coupled with the two or more manifolds, the base station including a processor and memory configured for activating the switching means of each manifold of the two or more manifolds to connect the egress outlet to one of the two or more conduits, and d) a piece of furniture having a top surface with a centrally located cutout, the cutout having a rear wall, opposed side walls and a floor, and the cutout containing each receptacle of the two or more smoking assemblies on the floor.

2. The multi-user smoking system of claim 1, further comprising two or more smoking hoses, each smoking hose fluidly coupled with an egress outlet of a particular manifold of the two or more manifolds.

3. The multi-user smoking system of claim 2, further comprising each smoking hose of the two or more smoking hoses including an interface for indicating a selection of a receptacle from a particular smoking assembly of the two or more smoking assemblies.

4. The multi-user smoking system of claim 3, further comprising each smoking hose of the two or more smoking hoses including a circuit board housing the interface for indicating a selection of a receptacle from a particular smoking assembly of the two or more smoking assemblies, wherein said circuit board includes a RF transmitter for transmitting said selection.

5. The multi-user smoking system of claim 4, the base station further comprising a radio frequency receiver for receiving from each smoking hose of the two or more smoking hoses a selection of a receptacle from a particular smoking assembly of the two or more smoking assemblies.

6. The multi-user smoking system of claim 5, wherein the switching means of each manifold of the two or more manifolds comprises a first solenoid for controlling a first opening to a first conduit of the two or more conduits, and a second solenoid for controlling a second opening to a second conduit of the two or more conduits.

7. The multi-user smoking system of claim 6, wherein each egress outlet of the two or more manifolds includes a check valve that only allows fluid to egress from the egress outlet and restricts fluid from entering the egress outlet.

8. A multi-user smoking system comprising:

a) two or more smoking assemblies, each smoking assembly including: 1) a receptacle for holding smoking material, 2) a water vessel, and 3) a stem conduit that fluidly connects the receptacle to the water vessel;

b) two or more manifolds, each manifold including: 1) an egress outlet, 2) two or more conduits, wherein each conduit of the two or more conduits is connected to a water vessel of a particular smoking assembly of the two or more smoking assemblies, and 3) a switching means for fluidly connecting the egress outlet to one of the two or more conduits, the switching means mechanism disposed within the manifold, the switching means comprising a solenoid-actuated valve connected to each of the two or more conduits, each solenoid-actuated valve configured to selectively permit or prevent smoke to flow from a conduit of the two or more conduits to the egress outlet, such that opening of one solenoid-actuated valve automatically closes the remaining solenoid-actuated valves;

c) two or more smoking hoses, each smoking hose fluidly coupled with an egress outlet of a particular manifold of the two or more manifolds, and each smoking hose including an interface for indicating a selection of a receptacle from a particular smoking assembly of the two or more smoking assemblies; and d) a base station communicatively coupled with the two or more manifolds, the base station including a processor and memory configured for: 1) reading from each hose of the two or more smoking hoses a selection of a receptacle from a particular smoking assembly of the two or more smoking assemblies, and 2) activating the switching means of each manifold of the two or more manifolds to connect the egress outlet to one of the two or more conduits, according to the selections that were read from each hose of the two or more smoking hoses, and e) a piece of furniture having a top surface with a centrally located cutout, the cutout having a rear wall, opposed side walls and a floor, and the cutout containing each receptacle of the two or more smoking assemblies on the floor.

9. The multi-user smoking system of claim 8, wherein the interface of each smoking hose of the two or more smoking hoses comprises one or more buttons.

10. The multi-user smoking system of claim 9, wherein the interface of each smoking hose of the two or more smoking hoses comprises one or more lights for indicating a selection of a receptacle from a particular smoking assembly of the two or more smoking assemblies.

11. The multi-user smoking system of claim 10, further comprising each smoking hose of the two or more smoking hoses including a circuit board housing the interface for indicating a selection of a receptacle from a particular smoking assembly of the two or more smoking assemblies, wherein said circuit board includes a RF transmitter for transmitting said selection.

12. The multi-user smoking system of claim 11, the base station further comprising a RF receiver for receiving from each smoking hose of the two or more smoking hoses a selection of a receptacle from a particular smoking assembly of the two or more smoking assemblies.

13. The multi-user smoking system of claim 12, wherein the switching means of each manifold of the two or more manifolds comprises a first solenoid for controlling a first opening to a first conduit of the two or more conduits, and a second solenoid for controlling a second opening to a second conduit of the two or more conduits.

14. The multi-user smoking system of claim 13, wherein each egress outlet of the two or more manifolds includes a check valve that only allows fluid to egress from the egress outlet and restricts fluid from entering the egress outlet.

15. A multi-user smoking system comprising:

a) two or more smoking assemblies, each smoking assembly including: 1) a receptacle for holding smoking material, 2) a water vessel, and 3) a stem conduit that fluidly connects the receptacle to the water vessel;

b) two or more manifolds, each manifold including: 1) an egress outlet, 2) two or more conduits, wherein each particular conduit of the two or more conduits is connected to a water vessel of a smoking assembly of the two or more smoking assemblies, 3) a switching means for fluidly connecting the egress outlet to one of the two or more conduits, the switching means mechanism disposed within the manifold, the switching means comprising a solenoid-actuated valve connected to each of the two or more conduits, each solenoid-actuated valve configured to selectively permit or prevent smoke to flow from a conduit of the two or more conduits to the egress outlet, such that opening of one solenoid-actuated valve automatically closes the remaining solenoid-actuated valves, and 4) an interface for activating the switching means of each manifold of the two or more manifolds to connect the egress outlet to one of the two or more conduits, and c) a piece of furniture having a top surface with a centrally located cutout, the cutout having a rear wall, opposed side walls and a floor, and the cutout containing each receptacle of the two or more smoking assemblies on the floor.

16. The multi-user smoking system of claim 15, further comprising two or more smoking hoses, each smoking hose fluidly coupled with an egress outlet of a particular manifold of the two or more manifolds.

17. The multi-user smoking system of claim 16, wherein each smoking hose of the two or more smoking hoses includes a mouthpiece at a distal end.

18. The multi-user smoking system of claim 17, wherein the switching means of each manifold of the two or more manifolds comprises a first solenoid for controlling a first opening to a first conduit of the two or more conduits, and a second solenoid for controlling a second opening to a second conduit of the two or more conduits.

19. The multi-user smoking system of claim 18, wherein each egress outlet of the two or more manifolds includes a check valve that only allows fluid to egress from the egress outlet and restricts fluid from entering the egress outlet.

20. The multi-user smoking system of claim 19, further comprising a table within which the two or more smoking assemblies and the two or more smoking manifolds are located.

* * * * *